United States Patent [19]

Jacobs

[11] Patent Number: 4,474,304

[45] Date of Patent: Oct. 2, 1984

[54] PLASTIC CONTAINER LID WITH TEAR-AWAY TAMPER RESISTANT SEALING STRIP

[76] Inventor: Stanley A. Jacobs, P.O. Box 606, 195 Church St., New Haven, Conn. 06503

[21] Appl. No.: 469,251

[22] Filed: Feb. 24, 1983

[51] Int. Cl.[3] ..... B65D 17/40

[52] U.S. Cl. ..... 220/276; 215/256; 220/270

[58] Field of Search ..... 220/270, 276; 215/256, 215/258

[56] References Cited

U.S. PATENT DOCUMENTS 3,608,765 9/1971 Faulstich ..... 215/256

4,033,472 7/1977 Aichinger ..... 215/256

*Primary Examiner*—George T. Hall

*Attorney, Agent, or Firm*—Wolf, Greenfield & Sacks

[57] ABSTRACT

A plastic container and a one-piece molded plastic lid for the container are provided with a tamper resistant, hermetic seal. The lid includes a top wall and a surrounding depending sidewall. The sidewall has a thin upper web upper portion and a relatively thick lower skirt portion. The mouth of the container includes a circumferential lip. The thin web deforms as the lid is snap fitted onto the container. The deformable web stretches into close conformity and sealing engagement with the lip of the container, the lower skirt region of the lid maintaining the web in a tightly constricted configuration about the lip. The skirt is sealed to the sidewall of the plastic container by a circumferential sealing strip formed integrally with and extending downwardly from the lower edge of the lid skirt. The lower portion of the sealing strip is attached directly to the sidewall of the plastic container by adhesive or welding. The connections between the sealing strip and both the container and the lower edge of the skirt of the lid are narrow to define weakened tear lines. A portion of the tear strip is formed to protrude and define a starter tab which may be gripped easily by the user to initiate tearing of the tear strip.

6 Claims, 5 Drawing Figures

Fig. 1
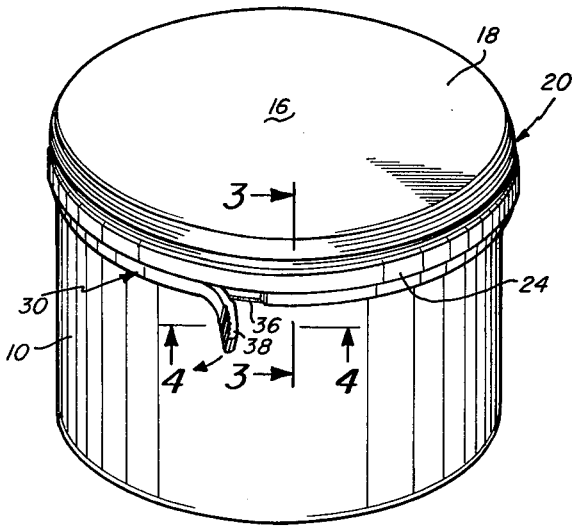
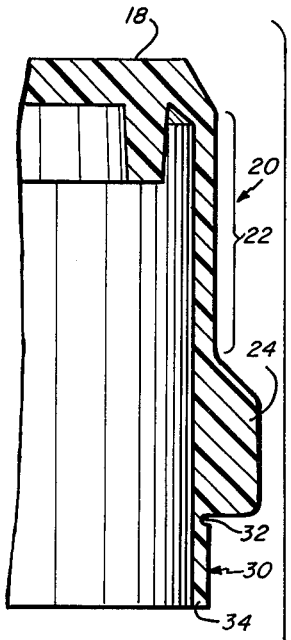
Fig.2
Fig. 3
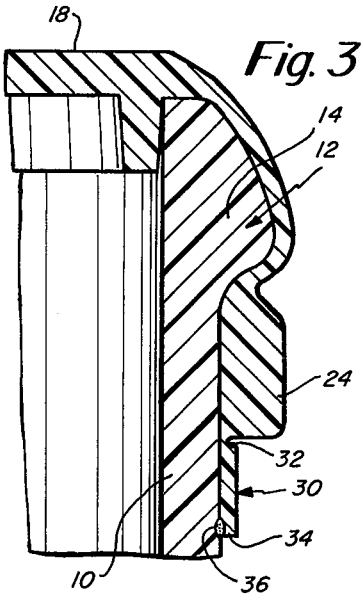
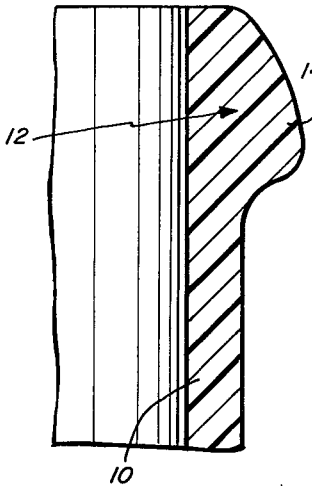
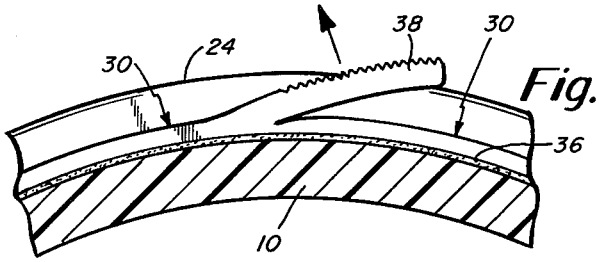
Fig. 4

PLASTIC CONTAINER LID WITH TEAR-AWAY TAMPER RESISTANT SEALING STRIP

BACKGROUND AND SUMMARY OF THE INVENTION

This invention relates to improvements in plastic containers and snap-on lids for such containers. More particularly, the invention relates to provision of a secondary sealing arrangement which has tamper resistant qualities as well as providing an hermetic seal. The invention is usable in a wide variety of environments which may include, by way of example only, containers for medicines in which it is desirable to provide a tamper resistant feature as well as containers for paint or for foods where it is desirable to package them for long shelf life in an hermetic seal. Additionally, it is among the general objects of the invention to provide a container and lid having these qualities yet which may be reusable and in which a highly effective reusable seal may be maintained by the main sealing structure. Thus, in accordance with the present invention, the tearaway sealing strip may be considered as an initial, but supplementary seal in addition to the primary reusable seal between the lid and the container.

The present invention may be utilized in conjunction with a lid of the type described in my U.S. Pat. No. 4,279,358 or in my co-pending application Ser. No. 379,746 which discloses a plastic lid in conjunction with a plastic can. The lid has a top wall and a circumferentially downwardly extending sidewall. The sidewall is shaped to cooperate with the lip at the upper end of the container to provide a special snap fit in which a thin web segment of the sidewall stretches about the lip and forms the primary reusable seal. The lower skirt portion of the sidewall is thicker and serves to constrict the sidewall about the lip of the container to draw and stretch the web against the lip.

In accordance with the present invention, a tearable strip is molded integrally and in one piece with the lid and extends from the lower portion of the lid skirt. The lower portion of the tear strip is secured, as by adhesive or thermal welding, directly to the sidewall of the container. The tear strip thus provides a continuous circumferentially tearable strip which spans and seals the skirt-container wall region. In the illustrative embodiment the invention is in the form of a detachable tearaway strip. The strip is at its weakest along the juncture to the lower edge of the skirt as well as along its point of connection to the sidewall of the container. The tear strip also is provided with an integrally molded starting tab which may be easily gripped by the user to initiate a tearaway action of the strip.

It is among the general objects of the invention to provide an improved plastic container and one-piece molded plastic lid having a snap-on seal and a secondary tamper resistant hermetic seal.

Another objective of the invention is to provide a container and lid of the type described having a tearaway strip which bridges and forms a one-piece continuous integral tamper proof seal between the container lid and the sidewall of the container.

DESCRIPTION OF THE DRAWINGS

The foregoing and other objects and advantages of the invention will be appreciated more fully from the following further description thereof, with references to the accompanying drawings wherein:

FIG. 1 is an illustration of an embodiment of the container and lid illustrating the initiation of separation of the tear strip seal;

FIG. 2 is a sectional illustration of the lid and container rim before the lid is placed on the container;

FIG. 3 is a sectional illustration of the lid in place and secured on the container with the tear strip secured to the container; and FIG. 4 is an illustration of the starter tab for the tear strip seen along the line 4—4 of FIG. 3.

DESCRIPTION OF THE ILLUSTRATIVE EMBODIMENT

As shown in FIGS. 1 and 2, the container is generally cylindrical having a sidewall 10, the upper end of which is provided with a rim 12 which includes a circumferential lip 14 protruding radially outwardly of the sidewall of the can. The container may be of the type described in my co-pending application Ser. No. 379,746 and may be formed from an appropriate plastic material such as high density polyethylene.

The lid 16 may be of the type described in my prior U.S. Pat. No. 4,279,358 or my application Ser. No. 379,746 or the like having a top wall 18 and a downwardly extending peripheral sidewall indicated generally at 20. The lid sidewall is formed to define at least two segments including a relatively thin, stretchable web segment 22 and a more substantial lower skirt portion 24 which is less elastic and stretchable than the web segment. As described in the aforementioned patent and application the lid is attached to the container by press fitting it over the rim 12. The relatively thick lower segment 24 is forced radially outwardly and expands as the lid is urged progressively onto the container. As the lid is advanced to cause the sidewall 20 to advance over the lip, the relatively thin web segment 22 will be stretched to a longer and thinner configuration and will wrap snugly and intimately about the lip of the container as suggested in FIG. 3. The foregoing engagement of the thin web segment 22 with the container lip forms a cooperative primary seal between the container and lid. This primary seal is reusable to enable the lid to be replaced when desired.

In accordance with the present invention the lid is provided with an additional depending tear strip segment which extends downwardly from the lower edge of the skirt portion of the lid sidewall. The juncture 32 between the tear strip segment 30 and the lower portion of the lid sidewall is sufficiently strong to maintain its integrity as an hermetic and a tamper resistant seal yet is sufficiently weak so as to provide a weakened peripheral tear line.

The lid is placed on the filled container as described in the aforementioned patent and application to cause the thin web segment to stretch about and seal against the rim of the container. Once the lid is in place the lower edge 34 of the tear strip 30 then is attached peripherally along and to the sidewall of the container along a seal line 36 (FIG. 3). The seal along the lower seal line 36 may be effected by adhesive or by thermal welding or the like. The seal 36 is continuous about the container. The circumferential connection 36 between the lower edge 34 of the tear strip 30 and the sidewall of the container also should be sufficiently strong to effect the hermetic, tamper resistant secondary seal while also defining a second, lower tear line along which the tear strip may be severed when pulled away from the container.

In order to help initiate the tearing away of the strip 30, a portion of the tear strip 30 is molded to define a tearaway tab 38. As shown in FIGS. 1 and 4 the tearaway tab 38 may be formed integrally in the molding or by a subsequent slitting operation, or by a combination of both molding and slitting.

From the foregoing it will be appreciated that the container, once filled, capped and adhesively or thermally sealed will provide a tamper resistant feature in that removal of the lid will require preliminary and permanent disruption of the tear strip. Additionally, the continuous and integral nature of the tear strip, which fully and entirely seals the lid to the container, provides for extended shelf life as a result of the hermetic seal achieved. Moreover, the resealing capability of the container, by reusable operation of the primary seal is retained intact.

It should be understood, however, that the foregoing description of the invention is intended merely to be illustrative thereof and that other embodiments and modifications may be apparent to those skilled in the art without departing from its spirit.

Having thus described the invention what I desire to claim and secure by Letters Patent is:

1. A plastic container and plastic lid therefor comprising, in combination:

said container having a sidewall, the upper end of the sidewall defining the mouth of the container;

the lid having a top wall and a sidewall extending downwardly and peripherally from the top wall of the lid, the lid and container being constructed and arranged so that when the lid is in place on the container the sidewall of the skirt extends about the sidewall of the container;

said lid and container sidewall being constructed and arranged so as to include cooperative primary sealing means, the primary sealing means being constructed to effect a reusable primary seal;

secondary sealing means comprising a sealing strip formed integrally with and extending downwardly from the lower region of the lid sidewall;

a circumferential region of the secondary sealing means being attached continuously to the container sidewall thereby to define a continuous and hermetic seal between the lid and container; and means for disrupting the seal and for separating the secondary connection between the lid and container sidewalls.

2. A container and lid therefor as defined in claim 1 wherein the secondary sealing means further comprises:

a peripheral strip extending downwardly from the lower edge of the lid sidewall and being attached to the lid sidewall by a weakened peripheral tear line;

the peripheral connection between the lower edge of the sealing strip and the container defining a weakened tear line, spaced from the first mentioned weakened tear line whereby the sealing strip may be torn away along both tear lines simultaneously to enable the strip to be detached from each of the container and lid.

3. A container and lid as defined in claim 2 wherein the secondary seal is attached to the container by thermal welding.

4. A container and lid as defined in claim 2 wherein the secondary seal is attached to the container by adhesive.

5. A container and lid as defined in claim 2 further comprising:

A starter tab formed integrally with and extending from the tear strip.

6. A container and lid therefor as defined in claim 1 further comprising:

the upper end of the container sidewall being formed to include a peripheral lip extending radially outwardly from the container sidewall;

the lid sidewall further comprising an upper, relatively thin web segment extending downwardly from the periphery of the top wall and a relatively thick skirt segment integral with and extending downwardly from the lower end of the web, the skirt and web being dimensioned so that the skirt will display a greater resistance to radial expansion than the web, the web being sufficiently thin and being dimensioned with respect to the container lip so that the web will stretch and deform to wrap around the periphery of the container lip while the skirt portion is constricted to maintain the web and sealing engagement with the container lip.

* * * * *